US009078320B2

(12) United States Patent
Wiegele et al.

(10) Patent No.: US 9,078,320 B2
(45) Date of Patent: Jul. 7, 2015

(54) VOLTAGE SUPPLY ARRANGEMENT AND METHOD FOR SUPPLYING VOLTAGE TO AN ELECTRICAL LOAD WITH TRANSISTOR SATURATION CONTROL

(75) Inventors: Stefan Wiegele, Graz (AT); Helmut Theiler, Lieboch (AT)

(73) Assignee: ams AG, Unterpremstaetten (AT)

( * ) Notice: Subject to any disclaimer, the term of this patent is extended or adjusted under 35 U.S.C. 154(b) by 0 days.

(21) Appl. No.: 14/232,237

(22) PCT Filed: Jun. 27, 2012

(86) PCT No.: PCT/EP2012/062486

§ 371 (c)(1),
(2), (4) Date: Apr. 8, 2014

(87) PCT Pub. No.: WO2013/007523

PCT Pub. Date: Jan. 17, 2013

(65) Prior Publication Data

US 2014/0232271 A1 Aug. 21, 2014

(30) Foreign Application Priority Data

Jul. 11, 2011 (DE) ..... 10 2011 107 089

(51) Int. Cl.
*H05B 37/02* (2006.01)
*H05B 33/08* (2006.01)

(52) U.S. Cl.
CPC ..... *H05B 33/0818* (2013.01); *H05B 33/0815* (2013.01); *H05B 33/0827* (2013.01); *H05B 33/0887* (2013.01)

(58) Field of Classification Search
USPC ..... 315/224, 291, 307, 308, 246, 247, 185 R
See application file for complete search history.

(56) References Cited

U.S. PATENT DOCUMENTS

| | | | | |
|---|---|---|---|---|
| 6,153,985 | A | 11/2000 | Grossman | |
| 7,312,597 | B2 | 12/2007 | Fahlenkamp et al. | |
| 7,760,057 | B2 | 7/2010 | Leipold et al. | |
| 2008/0042599 | A1 | 2/2008 | Ashdown | |
| 2008/0129225 | A1 | 6/2008 | Yamamoto et al. | |
| 2009/0015172 | A1 * | 1/2009 | Huang et al. | 315/246 |
| 2009/0295775 | A1 | 12/2009 | Kim et al. | |
| 2013/0069555 | A1 * | 3/2013 | Balakrishnan | 315/224 |
| 2013/0134893 | A1 | 5/2013 | Zimmermann et al. | |

FOREIGN PATENT DOCUMENTS

| | | | |
|---|---|---|---|
| DE | 102004036522 | A1 | 3/2006 |
| DE | 102005028403 | A1 | 12/2006 |

(Continued)

*Primary Examiner* — David H Vu

(74) *Attorney, Agent, or Firm* — McDermott Will & Emery LLP

(57) ABSTRACT

A voltage supply arrangement for driving an electrical load, particularly a light-emitting diode, comprises a driver circuit (11). The driver circuit (11) features a driver output (12) for making available a driver signal (SB) for controlling a load path (34) that comprises a means (36) for connecting the electrical load (37). The driver circuit (11) furthermore comprises a device (13) for determining an AC signal component of the driver signal (SB), the input side of which is coupled to the driver output (12) and at the output side of which can be tapped a measurement signal (SI) that is dependent on the AC signal component of the driver signal (SB) and according to which a supply voltage (VOUT) of the load path (34) can be adjusted.

15 Claims, 7 Drawing Sheets

(56) References Cited

FOREIGN PATENT DOCUMENTS

| | | | |
|---|---|---|---|
| DE | 102006003446 | A1 | 8/2007 |
| DE | 102010031239 | A1 | 9/2011 |
| EP | 1364737 | A1 | 11/2003 |
| EP | 1499165 | A2 | 1/2005 |
| EP | 2315497 | A1 | 4/2011 |
| WO | 2010/0131889 | A2 | 11/2010 |

* cited by examiner

VOLTAGE SUPPLY ARRANGEMENT AND METHOD FOR SUPPLYING VOLTAGE TO AN ELECTRICAL LOAD WITH TRANSISTOR SATURATION CONTROL

The invention pertains to a voltage supply arrangement and a method for supplying voltage to an electrical load.

BACKGROUND OF THE INVENTION

An electrical load may comprise a light-emitting diode, abbreviated LED, or several light-emitting diodes. A current source frequently is arranged in series with a light-emitting diode.

Document DE 102005028403 A1 describes a current source arrangement for driving an electrical load. An electrical load comprises, for example, several LEDs, a current source transistor and a resistor that are arranged in series. A node between the current source transistor and an LED or a control terminal of the current source transistor is connected to a feedback input of a direct voltage regulator via a signaling line.

It is the objective of the present invention to make available a voltage supply, as well as a method for supplying voltage to an electrical load, in which a current flowing through the load path can be maintained as constant as possible.

SUMMARY OF THE INVENTION

In one embodiment, a voltage supply arrangement for driving an electrical load, particularly a light-emitting diode, comprises a driver circuit. The driver circuit features a driver output and a device for determining an AC signal component of the driver signal. The driver output is designed for making available a driver signal for controlling a load path. The load path comprises a means of connecting the electrical load. The input side of the device for determining an AC signal component of the driver signal is coupled to the driver output. A measurement signal that is dependent on the AC signal component of the driver signal can be tapped on the output side of the device for determining an AC signal component of the driver signal. A supply voltage of the load path can be adjusted according to the measurement signal.

Consequently, the supply voltage depends on the measurement signal and therefore on the AC signal component of the driver signal. A high AC signal component of the driver signal may indicate, for example, an excessively low value of the supply voltage. If the value of the supply voltage is increased, it is therefore possible, for example, to reduce a deviation of the load current flowing through the load path from a default value. A very low value of the AC signal component, in contrast, may indicate an excessively high value of the supply voltage.

In one embodiment, the driver signal controls the load current flowing through the load path.

In one embodiment, the driver signal controls the load current.

In one embodiment, the voltage supply arrangement comprises a voltage regulator. The voltage regulator delivers the supply voltage to the load path with a ripple. The driver signal therefore has the AC signal component. The voltage regulator is implemented in the form of a DC/DC converter.

In one embodiment, the AC signal component of the driver signal corresponds to the ripple of the driver signal. The driver signal may have a DC signal component and an AC signal component superimposed on the DC signal component.

In one embodiment, the driver signal is realized in the form of a voltage. The driver signal therefore is realized in the form of a direct voltage and one or more superimposed alternating voltages. The AC signal component of the driver signal therefore can be determined in the form of the effective value of the superimposed alternating voltages. Alternatively, the AC signal component of the driver signal can be determined in the form of the difference between a minimum and a maximum of the driver signal over a period of time. The AC signal component therefore corresponds to a peak-to-peak value. The period of time may be a period of the operating phases of the connectable voltage regulator. At its output, the voltage regulator delivers the supply voltage, with which the load path is supplied. The supply voltage drops over the load path.

In one embodiment, the driver circuit is designed for generating the measurement signal in such a way that the AC signal component of the driver signal is lower than a predefined value. At a low AC signal component of the driver signal, a fluctuation in the load current flowing through the load path is also advantageously maintained small.

In one embodiment, the load path comprises a current source and the means for connecting the electrical load. The current source is coupled to the driver output at a control input. The current source and the means for connecting the electrical load form a series circuit. The load path may furthermore feature a feedback terminal that is coupled to a feedback input of the driver circuit. The load current flows through the current source. The driver signal controls the current source and therefore the load current.

In an enhancement, the load path comprises the current source and the electrical load that is arranged in series with the current source. The load current flows through the current source.

The electrical load may feature a light-emitting diode or a series circuit of light-emitting diodes.

In an enhancement, the current source comprises a transistor. A control terminal of the transistor is coupled to the driver output. The load current flows through the transistor. The driver circuit may be designed for generating the measurement signal in such a way that the transistor is operated above the saturation voltage.

In one embodiment, the transistor is realized in the form of a bipolar transistor. The measurement signal is generated in such a way that the bipolar transistor is operated in the normal mode. In the normal mode, the base-emitter diode of the bipolar transistor is conductive and the base-collector diode blocks. The bipolar transistor is in the normal mode when it is operated above the saturation voltage. In the normal mode, the current flowing through the bipolar transistor advantageously is only marginally dependent on the collector-emitter voltage dropping between the first and the second terminal of the bipolar transistor. Fluctuations of the supply voltage advantageously lead to only slight changes of the load current in the normal mode of the bipolar transistor.

In an alternative embodiment, the transistor is realized in the form of a field effect transistor. The measurement signal is generated in such a way that the field effect transistor is operated in the saturation range. In the saturation range, the current flowing through the field effect transistor is nearly independent of the drain-source voltage dropping between the first and the second terminal of the field effect transistor. Consequently, fluctuations of the supply voltage advantageously lead to only slight fluctuations of the load current in the saturation range. The field effect transistor is in the saturation range when it is operated above the saturation voltage.

In one embodiment, the device for determining an AC signal component of the driver signal comprises a filter circuit and a first comparator. A first input of the comparator is coupled to the driver output via the filter circuit. A second input of the first comparator may be coupled to an output of a reference signal source. The reference signal source makes available a predefined reference signal. The reference signal source connects the second input of the first comparator to a reference potential terminal. The measurement signal is tapped at an output of the first comparator. Alternatively, the second input of the first comparator may be coupled to the driver output.

The filter circuit may feature a circuit from the group comprising a high-pass filter, a low-pass filter and a peak value detector. The filter circuit may be realized in the form of a resistive-capacitive filter, abbreviated RC filter. The filter circuit may be implemented in the form of a first-order filter circuit.

In one embodiment, the driver circuit comprises a device for determining a DC signal component of the driver signal. The input side of the device for determining a DC signal component of the driver signal is coupled to the driver output. An additional measurement signal that is dependent on the DC signal component of the driver signal is delivered at an output of the device. In this case, the supply voltage is adjusted according to the measurement signal and the additional measurement signal. Consequently, the AC signal component, as well as the DC signal component of the driver signal, is used in the feedback loop in order to drive the voltage regulator. A high value of the DC signal component of the driver signal indicates, for example, an excessively low value of the supply voltage. A very low value of the DC signal component of the driver signal, in contrast, may indicate an excessively high value of the supply voltage. If the supply voltage is reduced in the latter instance, the energy consumption of the current source drops such that the efficiency is increased.

In one embodiment, the device for determining an AC signal component of the driver signal comprises a second comparator. A first input of the second comparator is coupled to the driver output. A second input of the second comparator is coupled to an output of a comparison signal source. The comparison signal source delivers a predefined comparison signal. The comparison signal source couples the second input of the second comparator to the reference potential terminal. The additional measurement signal is made available at an output of the second comparator.

In one embodiment, the driver circuit comprises an evaluation circuit. The measurement signal is fed to a first input of the evaluation circuit and the additional measurement signal is fed to the second input of the evaluation circuit. The first input of the evaluation circuit therefore is coupled to the output of the device for determining an AC signal component of the driver signal. The second input of the evaluation circuit, in contrast, is coupled to the output of the device for determining a DC signal component of the driver signal.

In one embodiment, the first input of the evaluation circuit is connected to the output of the first comparator and the second input of the evaluation circuit is connected to the output of the second comparator.

In one embodiment, a feedback signal is delivered at an output of the evaluation circuit. The evaluation circuit generates the feedback signal from the measurement signal and the additional measurement signal. The feedback signal is designed for adjusting the voltage conversion from an input voltage to the supply voltage. The feedback signal therefore serves for controlling the voltage regulator.

In one embodiment, the evaluation circuit comprises a logic gate. At its first input, the logic gate is coupled to the output of the device for determining an AC signal component of the driver signal via the first input of the evaluation circuit. At a second input, the logic gate is coupled to the output of the device for determining a DC signal component of the driver signal via the second input of the evaluation circuit. At an output, the logic gate is connected to the output of the evaluation circuit. The logic gate may have an OR function.

In an enhancement, an input voltage is fed to a voltage regulator input of the voltage regulator. The load path is connected to a voltage regulator output of the voltage regulator. The supply voltage is made available at the voltage regulator output. A feedback input of the voltage regulator is coupled to the output of the evaluation circuit. The voltage regulator may be realized in the form of a buck converter, a boost converter or a buck-boost converter. The voltage regulator is operated in a clocked fashion.

In one embodiment, a semiconductor body comprises the driver circuit. The driver circuit is integrated on a first primary surface of the semiconductor body. In addition, at least the transistor or the voltage regulator may be integrated on the first primary surface of the semiconductor body.

The voltage supply arrangement can be utilized for realizing a backlight. For example, the voltage supply arrangement may be utilized for implementing a multichannel backlight.

In one embodiment, a method for supplying voltage to an electrical load, particularly a light-emitting diode, comprises a conversion of an input voltage into a supply voltage of a load path according to a feedback signal. In this case, the supply voltage is generated according to an input voltage and a feedback signal. The load current flowing through the load path is controlled by means of a driver signal. An AC signal component of the driver signal is determined. The feedback signal is generated according to the AC signal component of the driver signal.

The AC signal component of the driver signal advantageously influences the supply voltage by means of the feedback signal. Consequently, the supply voltage is increased at a high value of the AC signal component of the driver signal. The increase of the supply voltage advantageously leads to an improvement of the constancy of the load current.

In one embodiment, a voltage regulator delivers the supply voltage to the load path with a ripple. The voltage regulator is implemented in the form of a DC/DC converter. The driver signal has the AC signal component due to the ripple of the supply voltage.

The measurement signal may be defined in the form of a value that is correlated with the signal components of the driver signal that have higher frequencies.

The filter circuit may be realized in the form of a circuit that receives the driver signal on the input side and makes a signal available on the output side that is realized in the form of a quantity for the AC component of the driver signal.

BRIEF DESCRIPTION OF THE DRAWINGS

Several embodiment examples of the invention are described in greater detail below with reference to the figures. Components or functional units with respectively identical function or operation are identified with the same reference symbols. The description of components or functional units with identical function is not repeated in each of the following figures. In these figures.

DETAILED DESCRIPTION

Figure 1A:
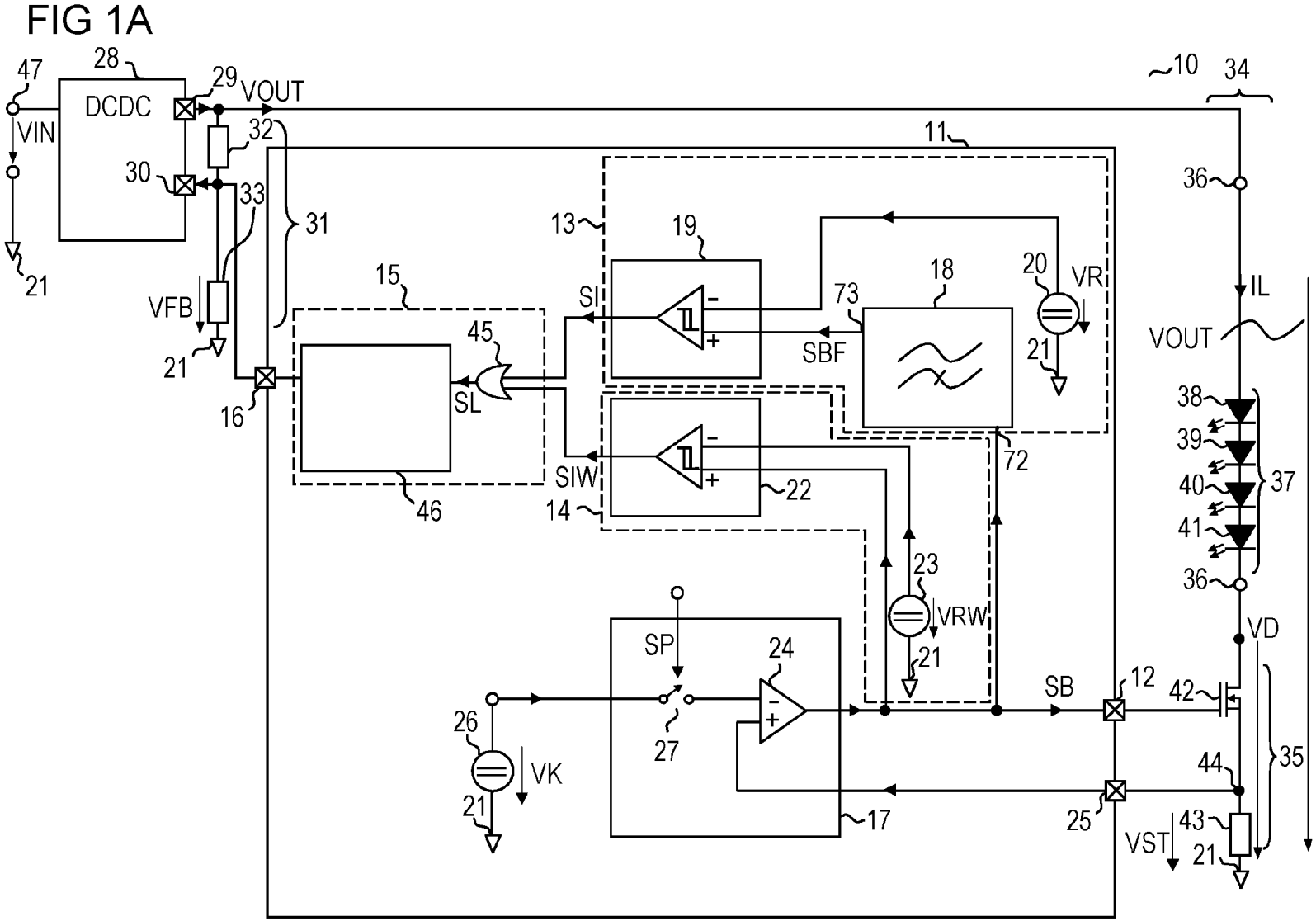
FIGS. 1A-1D show embodiment examples of a voltage supply arrangement according to the proposed principle.

FIG. 1A shows an example of a voltage supply arrangement according to the proposed principle. The voltage supply arrangement 10 comprises a driver circuit 11 with a driver output 12. The driver circuit 11 furthermore comprises a device 13 for determining an AC signal component of the driver signal SB. In addition, the driver circuit 11 comprises a device 14 for determining a DC signal component of the driver signal SB. An input of the device 13 for determining an AC signal component of the driver signal is connected to the driver output 12. Likewise, an input of the device 14 for determining a DC signal component of the driver signal is connected to the driver output 12.

The driver circuit 11 furthermore features an evaluation circuit 15. A first input of the evaluation circuit 15 is connected to the output of the device 13 for determining an AC signal component of the driver signal. Accordingly, a second input of the evaluation circuit 15 is connected to an output of the device 14 for determining a DC signal component of the driver signal. The output side of the evaluation circuit 15 is connected to a feedback output 16 of the driver circuit 11. In addition, the driver circuit 11 features a signal generator 17, the output of which is coupled to the driver output 12.

The device 13 for determining an AC signal component of the driver signal comprises a filter circuit 18 and a first comparator 19. The filter circuit 18 connects the driver output 12 to a first input of the first comparator 19. A reference signal source 20 couples a second input of the first comparator 19 to a reference potential terminal 21. An output of the first comparator 19 is connected to the input of the device 13 for determining an AC signal component of the driver signal. The device 14 for determining a DC signal component of the driver signal comprises a second comparator 22. A first input of the second comparator 22 is connected to the driver output 12. A comparison signal source 23 couples a second input of the second comparator 22 to the reference potential terminal 21. An output of the second comparator 22 is connected to the input of the device 14 for determining a DC signal component of the driver signal.

The signal generator 17 comprises an operational amplifier 24, the output of which is connected to the output of the signal generator 17. A feedback input 25 of the driver circuit 11 is connected to a first input of the signal generator 17 and therefore to a first input of the operational amplifier 24. A second input of the signal generator 17 is connected to the reference potential terminal 21 via a constant voltage source 26. The signal generator 17 features a switch 27 that couples the constant voltage source 26 to the second input of the operational amplifier 24.

The voltage supply arrangement 10 furthermore comprises a voltage regulator 28 with a voltage regulator output 29 and a feedback input 30. The feedback input 30 is coupled to the feedback output 16 of the driver circuit 11. A voltage divider 31 connects the voltage regulator output 29 to the reference potential terminal 21. The voltage divider 31 features a first and a second voltage-dividing resistor 32, 33. A tap between the first and the second voltage-dividing resistor 32, 33 is connected to the feedback input 30.

In addition, the voltage supply arrangement 10 comprises a load path 34 with a current source 35. A control terminal of the current source 35 is connected to the driver output 12. In addition, the load path 34 features a means 36 for connecting an electrical load 37. The load path 34 furthermore features the electrical load 37. The electrical load 37 comprises at least one light-emitting diode 38. For example, the electrical load 37 comprises four light-emitting diodes 38-41. The electrical load 37 is connected to the load path 34 via the means 36 for connecting the electrical load. The load path 34 couples the voltage regulator output 29 to the reference potential terminal 21. The current source 35 features a transistor 42. The transistor 42 is realized in the form of a power transistor. The transistor 42 is implemented in the form of a field effect transistor. The transistor 42 may be realized in the form of an n-channel metal oxide semiconductor field effect transistor. Furthermore, the current source 35 features a current-sensing resistor 43 that is arranged between the transistor 42 and the reference potential terminal 21. A feedback terminal 44 of the load path 34 is arranged between the transistor 42 and the current-sensing resistor 43. The feedback terminal 44 is connected to the feedback input 25 of the driver circuit 11.

The evaluation circuit 15 comprises a logic gate 45. The logic gate 45 has an OR function. A first input of the logic gate 45 is connected to the output of the first comparator 19. In addition, a second input of the logic gate 45 is connected to the output of the second comparator 22. The control circuit 46 of the evaluation circuit 15 connects the output of the logic gate 45 to the feedback output 16. The control circuit 46 may feature a digital/analog converter, which is not depicted. The digital/analog converter may feature a current output that is connected to the feedback output 16. The control circuit 46 may comprise a state machine.

An input voltage VIN is fed to a voltage regulator input 47 of the voltage regulator 28. The voltage regulator 28 delivers a supply voltage VOUT at the voltage regulator output 29. The input voltage and the supply voltage VIN, VOUT respectively refer to a reference potential applied to the reference potential terminal 21. The supply voltage VOUT is fed to the load path 34. A load current IL flows through the load path 34. The driver circuit 11 makes available a driver signal SB at the driver output 12. The driver signal SB is fed to the control terminal of the current source 35 and therefore to the control terminal of the transistor 42. A feedback signal VST can be tapped at the feedback terminal 44. The feedback signal VST is realized in the form of a voltage. The value of the voltage of the feedback signal VST corresponds to the product of the resistance value of the current-sensing resistor 43 and the value of the load current IL. The operational amplifier 24 and therefore the signal generator 17 make available the driver signal SB. The feedback signal VST is fed to the first input of the operational amplifier 24. A constant voltage VK is fed to the second input of the operational amplifier 24. The constant voltage VK is made available by the constant voltage source 26.

An activation signal SP is fed to the switch 27. The activation signal SP may be realized in the form of a pulse-width modulated signal. If the switch 27 is switched into the conductive state by means of the activation signal SP, the constant voltage VK is fed to the second input of the operational amplifier 24. In this case, the driver signal SB is adjusted in such a way that the feedback signal VST approximately corresponds to the constant voltage VK. The load current IL therefore assumes a predefined load current value. However, if the switch 27 is switched into the open state by means of the activation signal SP, the driver signal SB assumes a value at which the current source 35 is deactivated such that no load current IL flows.

The driver signal SB is fed to the device 13 for determining an AC signal component of the driver signal. The driver signal SB is filtered by means of the filter circuit 18 and fed to the first input of the first comparator 19 in the form of a filtered driver signal SBF. The reference signal source 20 delivers a reference signal VR that is fed to the second input of the first comparator 19. The filter circuit 18 is realized in the form of a high-pass filter. The first comparator 19 is implemented in the form of a comparator. The first comparator 19 makes available a measurement signal SI. The first comparator 19 compares the filtered driver signal SBF to the reference signal VR and delivers the measurement signal SI according to a comparison of the filtered driver signal SBF and the reference signal VR. If the filtered driver signal SBF has a value that is higher than the value of the reference signal VR, the measurement signal SI has a value that leads to an increase of the supply voltage VOUT. For example, the measurement signal SI has the logic value "1." The measurement signal SI therefore signals that the driver signal SB has an AC signal component that is higher than a predefined value. The value of the reference signal VR may be defined according to the filter characteristic of the filter circuit 18. The reference signal VR is realized in the form of a voltage.

The driver signal SB is likewise fed to the device 14 for determining a DC signal component of the driver signal. The driver signal SB is fed to the first input of the second comparator 22. The comparison signal source 23 delivers a comparison signal VRW. The comparison signal VRW may also be referred to as trip reference voltage. The comparison signal VRW is fed to the second input of the second comparator 22. The comparison signal VRW and the reference signal VR have predefined constant values. An additional measurement signal SIW can be tapped at the output of the second comparator 22 and therefore at the output of the device 14 for determining a DC signal component of the driver signal. The additional measurement signal SIW is made available by the second comparator 22 based on a comparison of the driver signal SB to the comparison signal VRW. The second comparator 22 is implemented in the form of a comparator.

If the driver signal SB assumes an excessively high value, the additional measurement signal SIW has a value that leads to an increase of the supply voltage VOUT such as, e.g., the logic value "1." The device 14 for determining a DC signal component of the driver signal serves for realizing a value of the driver signal SB that is smaller than the value of the comparison signal VRW. The comparison signal VRW may be defined according to an operating point of the transistor characteristic of the transistor 42. Alternatively, the value of the comparison voltage VRW may be chosen such that the second comparator 22 detects whether the driver signal SB lies close to a supply voltage of the operational amplifier 24. In this case, the operational amplifier 24 and therefore the signal generator 17 are outside the control range.

The measurement signal SI and the additional measurement signal SIW are fed to the evaluation circuit 15. The first and the second input of the logic gate 45 are acted upon with the measurement signal SI and the additional measurement signal SIW. The logic gate 45 generates a logic signal SL from a link between the measurement signal SI and the additional measurement signal SIW. The logic signal SL represents an OR function of the measurement signal SI and the additional measurement signal SIW. The logic signal SL is fed to the control circuit 46. A feedback signal VFB can be tapped at the feedback output 16. The feedback signal VFB is fed to the feedback input 30. The feedback signal VFB is generated from the supply voltage VOUT by means of the voltage divider 31 and from the logic signal SL by means of the control circuit 46.

The control circuit 46 is realized in such a way that the feedback signal VFB is lowered if the value of the logic signal SL leads to an increase in the supply voltage VOUT such as, e.g., the logic value "1." Consequently, the feedback signal VFB is reduced by means of the evaluation circuit 15 if the AC component of the driver signal SB is greater than or equal to a predefined value. The feedback signal VFB is likewise reduced by means of the evaluation circuit 15 if the value of the driver signal SB is higher than the value of the comparison signal VRW. If the feedback signal VFB is reduced, the voltage regulator 28 increases the value of the supply voltage VOUT. The voltage regulator 28 is implemented in the form of a DC/DC converter. When the logic signal SL assumes the value that leads to an increase of the supply voltage VOUT, the feedback signal VFB has a lower value such that the supply voltage VOUT is increased by means of the feedback mechanism in the voltage regulator 28.

The supply voltage VOUT is advantageously increased if the AC signal component of the driver signal SB or the DC signal component of the driver signal SB or both signal components of the driver signal SB are higher than the respectively predefined values. The increase of the supply voltage VOUT makes it possible to increase the value of a current source voltage VD that drops across the current source 35. Consequently, the transistor 42 advantageously operates above a saturation voltage. The drain-source voltage and the collector-emitter voltage of the transistor 42 are respectively greater than the saturation voltage. When the field effect transistor operates in the saturation range, the drain voltage has a high ripple and the source voltage has a low ripple. In the range of the saturation voltage, fluctuations of the supply voltage VOUT only slightly influence the load current IL flowing through the transistor 42. The control of the voltage regulator 28 therefore takes place according to the ripple of the driver signal SB of the current source 35. The operational amplifier 24 of the signal generator 17 advantageously needs to only fulfill characteristics that can be easily reached and therefore can be inexpensively realized. For example, only a small bandwidth and a low amplification factor are required. This is sufficient to cause the load current IL to assume the predefined value.

In one embodiment, a frequency of the activation signal SP is lower than a frequency with which the voltage regulator 28 is operated. The filter circuit 18 is designed in such a way that it has a high attenuation in the range of the frequency of the activation signal SP and a low attenuation in the range of the frequency of the voltage regulator 28. The filter circuit 18 therefore allows the AC signal component of the driver signal SB caused by fluctuations of the supply voltage VOUT to pass. However, the AC signal component of the driver signal SB caused by the activation signal SP is not allowed to pass by the filter circuit 18 and therefore leads to a reduction of the feedback signal VFB.

In an alternative embodiment, the frequency of the activation signal SP is higher than the frequency of the voltage regulator 28. The filter circuit 18 may be realized in the form of a band-pass filter. The filter circuit 18 has a low attenuation in the range of the frequency of the voltage regulator 28 and a high attenuation in the range of the frequency of the activation signal SP. In addition, the filter circuit 18 has a high attenuation at very low frequencies. It is advantageous that only alternating voltage components of the driver signal SB generated by the voltage regulator 28 are taken into consideration in the generation of the measurement signal SI and lead to a reduction of the feedback signal VFB.

In an alternative embodiment that is not shown, several load paths are arranged in parallel. The voltage regulator 28 therefore delivers the supply voltage VOUT to the load path 34, as well as additional load paths that are not shown. Additional driver circuits that are realized in accordance with the driver circuit 11 control the additional load paths. The feedback outputs of the respective driver circuits are connected to the feedback input 30. The electrical loads of the respective load paths may differ. For example, the electrical loads of the respective load paths may feature a different number of light-emitting diodes or light-emitting diodes with different conducting-state voltages. Consequently, the electrical loads of the different load paths may require different voltages for their operation. Several driver circuits according to the proposed principle advantageously make it possible for the voltage regulator 28 to also make the supply voltage VOUT available with such a value that each of the different electrical loads can be operated if different voltages are required by the respective electrical loads. It is advantageously prevented that the supply voltage VOUT increases excessively. In this way, the efficiency of the arrangement is increased and the power dissipation is reduced.

In an alternative embodiment that is not shown, the signal generator 17 features a controlled current source instead of the operational amplifier 24. The output of the controlled current source is connected to the driver output 12.

In an alternative embodiment that is not shown, the electrical load 37 comprises a number of light-emitting diodes that is not equal to four. The number amounts to at least one.

Figure 1B:
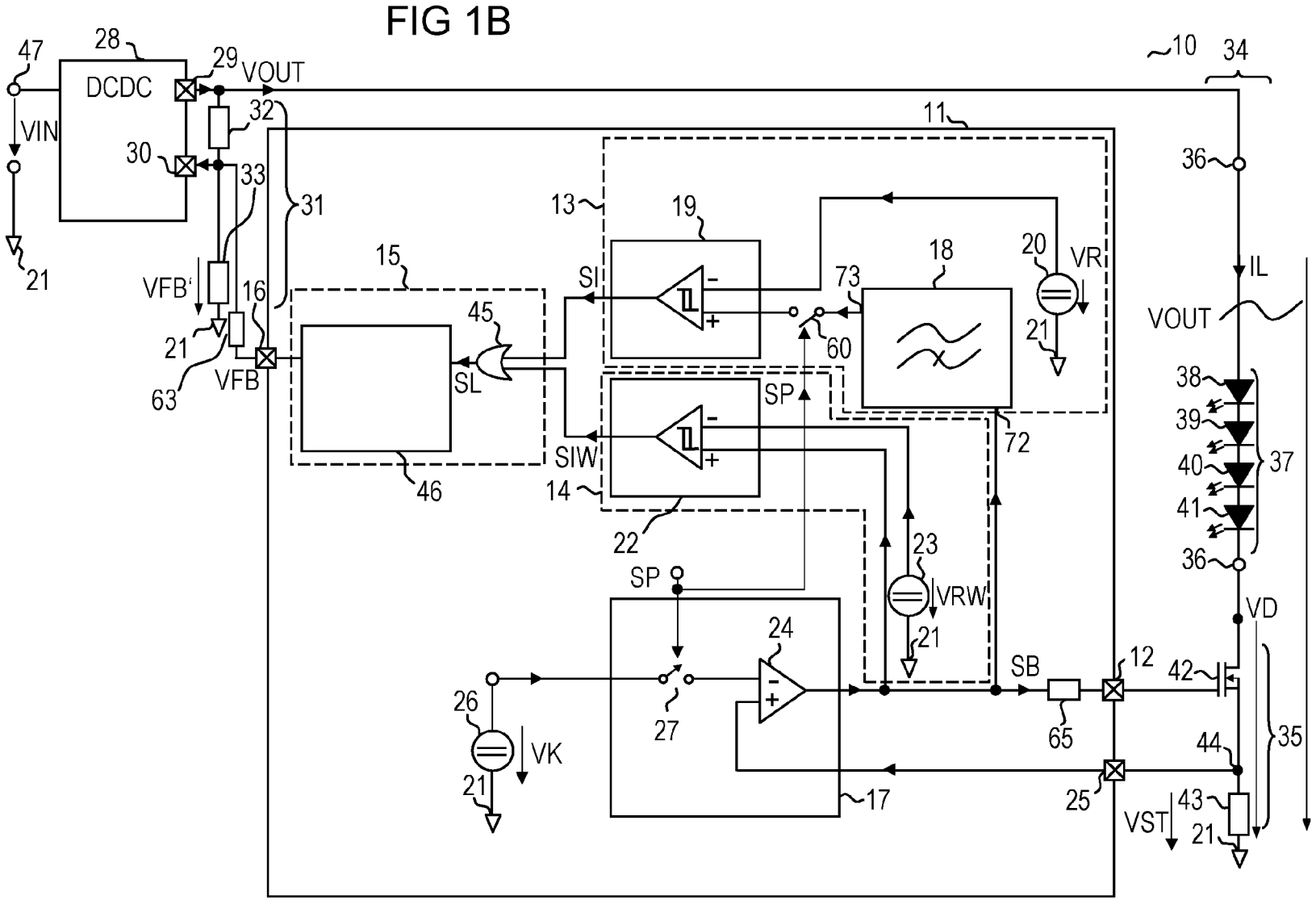

FIG. 1B shows another embodiment example of a voltage supply arrangement according to the proposed principle that represents an enhancement of the voltage supply arrangement illustrated in FIG. 1A. The device 13 for determining an AC signal component of the driver signal features an additional switch 60. The additional switch 60 couples the filter circuit 18 to the first input of the first comparator 19. The driver circuit 11 features a series resistor 65 that couples the output of the signal generator 17 to the driver output 12. A coupling resistor 63 of the voltage supply arrangement 10 connects the feedback output 16 to the tap between the first and the second voltage-dividing resistor 32, 33 and therefore to the feedback input 30.

The additional switch 60 therefore forwards the filtered driver signal SBF to the first comparator 19. The additional switch 60 is controlled by the activation signal SP. The activation signal is designed for the pulse-width modulation of the load current IL or for delivering individual pulses of the load current such as, e.g., for a flashing light. The current source 35 is switched into the conductive state at an activating value of the activation signal SP while the current source 35 is switched into the non-conductive state at a deactivating value of the activation signal SP. If the current source 35 is switched into the conductive state by means of the activation signal SP such that the load current IL flows through the electrical load 37, the additional switch 60 also forwards the filtered driver signal SBF to the first comparator 19. However, if the current source 35 is switched into the blocking state such that the load current IL assumes the value 0, no filtered driver signal SBF is fed to the first comparator 19. In this way, the measurement signal SI only signals that the AC signal component of the driver signal is greater than or equal to a predefined value when the electrical load 37 is activated.

The additional switch 60 therefore makes it possible to only reduce the feedback signal VFB when the current source 35 is operated. The activation signal SP causes a rapid change of the driver signal SB by means of the switch 27, wherein the change has a high absolute value. Due to the additional switch 60, such significant changes of the driver signal SB have no influence on the feedback signal VFB. An additional feedback signal VFB' is applied to the feedback input 30. The additional feedback signal VFB' can be distinguished from the feedback signal VFB by the voltage drop at the coupling resistor 63. The feedback signal VFB is generally lower than or equal to the additional feedback signal VFB'.

Fluctuations of the supply voltage VOUT advantageously cause a reduction of the feedback signal VFB. However, the modulation of the current source 35 by means of the activation signal SP has no influence on the feedback signal VFB. The filter circuit 18 is deactivated by means of the additional switch 60 when the activation signal SP has the logic value "0" such that the current source 35 is switched off. In addition, the filter circuit 18 is activated by means of the additional switch 60 when the activation signal SP has the logic value "1" such that the current source 35 is switched on.

In an alternative embodiment that is not shown, the additional switch 60 is realized in such a way that it is immediately opened at a value of the activation signal SP that deactivates the current source 35 and is closed with a time delay at a value of the activation signal SP that activates the current source 35. The time delay may amount, for example, to 40 μsec. In this case, the deactivation takes place immediately while the activation takes place with a time delay of 40 μsec.

In an alternative embodiment that is not shown, the additional switch 60 is arranged between the output of the first comparator 19 and the first input of the evaluation circuit 15 rather than between the filter circuit 18 and the first comparator 19. The measurement signal SI therefore has a value that leads to an increase of the supply voltage VOUT such as, e.g., the logic value "1" if the activation signal SP has the activating value and the AC signal component of the driver signal SB is greater than the reference signal VR. The measurement signal SI has a value that does not lead to an increase of the supply voltage VOUT such as, e.g., the logic value "0" if the activation signal SP has the deactivating value and/or the AC signal component of the driver signal SB is smaller than the reference signal VR. Alternatively, the first comparator 19 may be deactivated or activated by means of a switch.

Figure 1C:
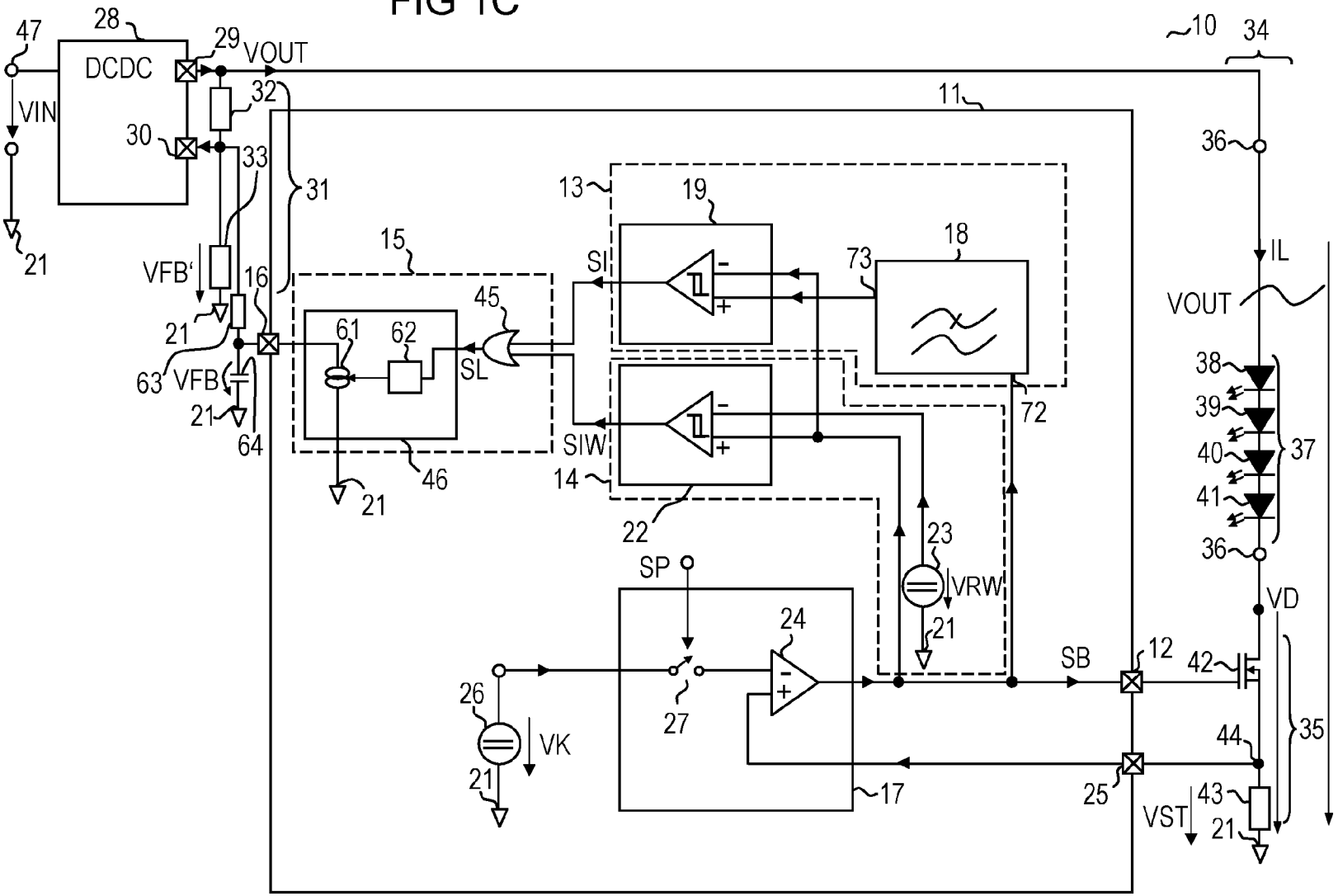

FIG. 1C shows an embodiment example of the voltage supply arrangement 10 according to the proposed principle that represents an enhancement of the voltage supply arrangements illustrated in FIGS. 1A and 1B. According to FIG. 1C, the second input of the first comparator 19 is coupled to the driver output 12. To this end, the second input of the first comparator 19 may be connected to the driver output 12. The filter circuit 18 is realized in the form of a low-pass filter.

The control circuit 46 features a controlled current source 61. The controlled current source 61 connects the feedback output 16 to the reference potential terminal 21. The control terminal of the controlled current source 61 is coupled to the output of the logic gate 45. A state machine 62 of the control circuit 46 connects the output of the logic gate 45 to the control terminal of the controlled current source 61. A low-pass filter of the voltage supply arrangement 10 couples the feedback output 16 to the feedback input 30. The low-pass filter is realized in the form of a resistive-capacitive low-pass filter. The low-pass filter comprises the coupling resistor 63 and a coupling capacitor 64. The coupling capacitor 64 connects the feedback output 16 to the reference potential terminal 21.

The driver signal SB is therefore fed to the second input of the first comparator 19. Consequently, the first comparator 19 makes available the measurement signal SI according to a comparison of the filtered driver signal SBF and the driver signal SB. If the driver signal SB is greater than the driver signal SBF filtered by means of the low-pass filter 18, the measurement signal SI therefore has a value that leads to an increase of the supply voltage VOUT such as, e.g., the logic value "1." Significant deflections of the driver signal SB from the driver signal SBF filtered by means of the low-pass filter 18 therefore generate the value of the measurement signal SI that leads to a reduction of the feedback signal VFB, namely the logic value "1." If the AC signal component of the driver signal SB exceeds the predefined value or is equal to the predefined value, the current flow through the controlled current source 61 increases and the value of the feedback signal VFB is reduced. If the logic signal SL has a value that leads to an increase of the supply voltage VOUT such as, e.g., the logic value "1," the current flow through the controlled current source 61 increases such that the value of the feedback signal VFB is reduced. The controlled current source 61 is implemented in the form of a digitally controlled current source. The state machine 62 adjusts the intensity of the current flow through the controlled current source 61 incrementally. The current flow through the controlled current source 61 causes a voltage drop at the coupling resistor 63. Consequently, the additional feedback voltage VFB' drops.

Figure 1D:
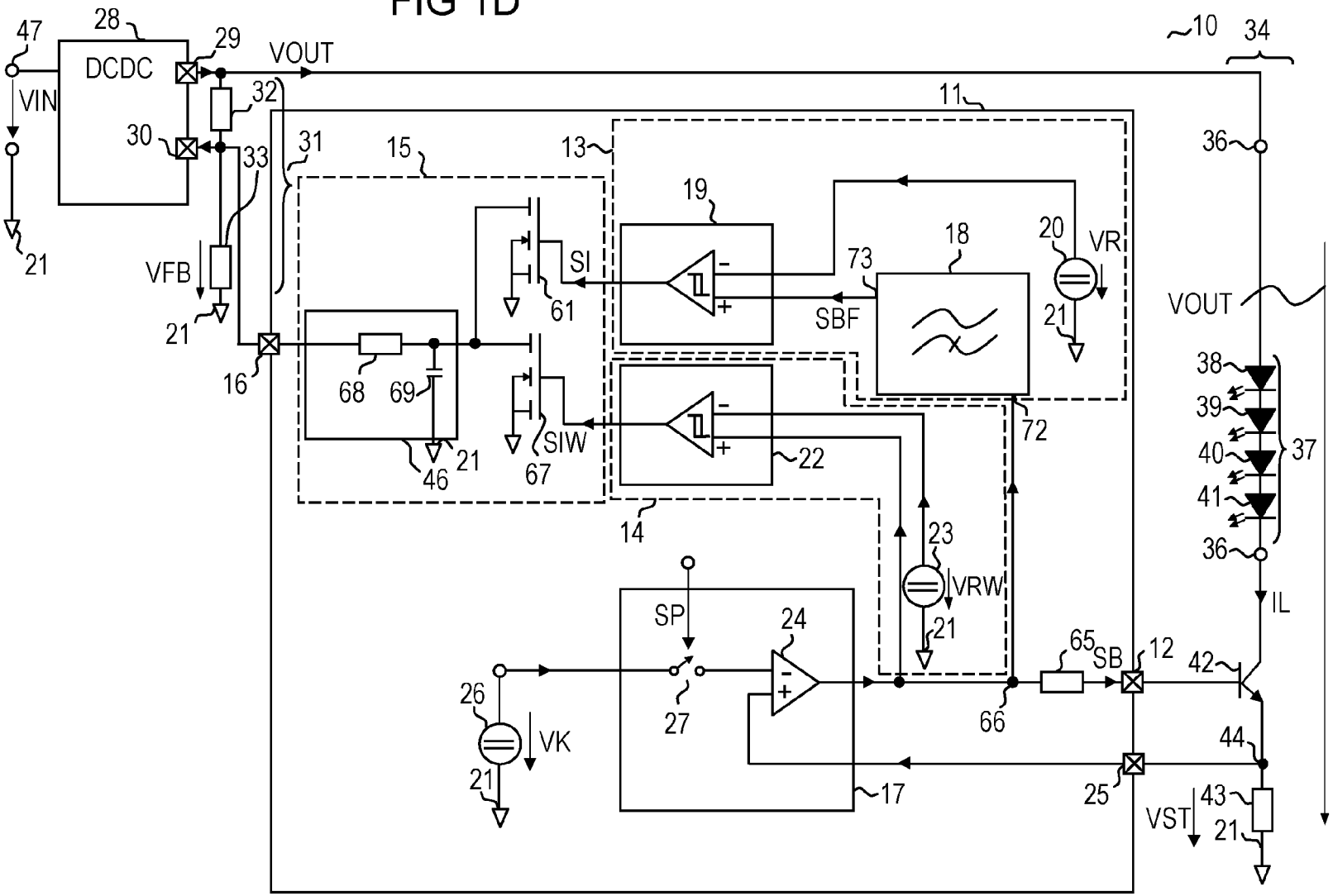

FIG. 1D shows another embodiment example of a voltage supply arrangement 10 according to the proposed principle that represents an enhancement of the voltage supply arrangements illustrated in FIGS. 1A-1C. According to FIG. 1D, the transistor 42 of the current source 35 is realized in the form of a bipolar transistor. The driver output 12 is connected to the base terminal of the bipolar transistor. The driver circuit 11 features the series resistor 65 that is arranged between the signal generator 17 and the driver output 12. The input sides of the device 13 for determining an AC signal component of the driver signal and the device 14 for determining a DC signal component of the driver signal are connected to the node 66 between the signal generator 17 and the series resistor 65. The filter circuit 18 couples the node 66 to the first input of the first comparator 19. The first input of the second comparator 22 is accordingly connected to the node 66.

The evaluation circuit 15 comprises the control transistor 61, the input side of which is coupled to the output of the device 13 for determining an AC signal component of the driver signal. In this case, the control terminal of the control transistor 61 is directly connected to the output of the device 13 for determining an AC signal component of the driver signal. The controlled section of the control transistor 61 is arranged in a current path between the feedback output 16 and the reference potential terminal 21. The evaluation circuit 15 comprises an additional control transistor 67, the control terminal of which is coupled to the output of the device 14 for determining a DC signal component of the driver signal. To this end, the control terminal of the additional control transistor 67 is directly connected to the output of the device 14 for determining a DC signal component of the driver signal. The controlled sections of the control transistor 61 and the additional control transistor 67 are arranged parallel to one another. The control circuit 46 features a control resistor 68. The control resistor 68 connects the feedback output 16 to the controlled sections of the control transistor 61 and the additional control transistor 67 that are connected in parallel. A control capacitor 69 of the control circuit 46 connects a node between the control transistor 68 and the controlled sections of the control transistor 61 and the additional control transistor 67 to the reference potential terminal 21. The control circuit 46 comprises a low-pass filter. The control capacitor 69 and the control resistor 68 form the low-pass filter. The first and the second comparator 19, 22 are implemented in the form of operational amplifiers or alternatively in the form of operational transconductance amplifiers. The measurement signal SI and the additional measurement signal SIW are realized in the form of analog signals. The first and the second comparator 19, 22 may have a predefined hysteresis. In this way, an excessively frequent change of the measurement signal SI and the additional measurement signal SIW is prevented.

The measurement signal SI is therefore fed to the control terminal of the control transistor 61. The additional measurement signal SIW is fed to the control terminal of the additional control transistor 67. The evaluation circuit 15 therefore features no logic gate 45. The logic linking of the measurement signal SI and the additional measurement signal SIW is implemented by means of the parallel circuit comprising the controlled sections of the control transistor 61 and the additional control transistor 67. The value of the measurement signal SI and/or the additional measurement signal SIW leading to an increase of the supply voltage VOUT such as, e.g., a voltage value other than 0 V, leads to an increase of the current flowing from the feedback output 16 to the reference potential terminal 21. The increased current generates a higher voltage drop in the first voltage-dividing resistor 32 such that the feedback signal VFB is reduced. Consequently, the value of the feedback signal VFB is reduced by a current flow through the control resistor 68, as well as the control transistor 61 and the additional control transistor 67, respectively. The feedback signal VFB therefore assumes a low value when the measurement signal SI and/or the additional measurement signal SIW assume(s) the value that leads to an increase of the supply voltage VOUT, i.e. a voltage value greater than 0 V. The generation of the feedback signal VFB from the driver signal SB is therefore realized with analog technology.

In an alternative embodiment, the first and the second comparator 19, 22 are implemented in the form of comparators. The measurement signal SI and the additional measurement signal SIW are realized in the form of digital signals.

Figure 2B:
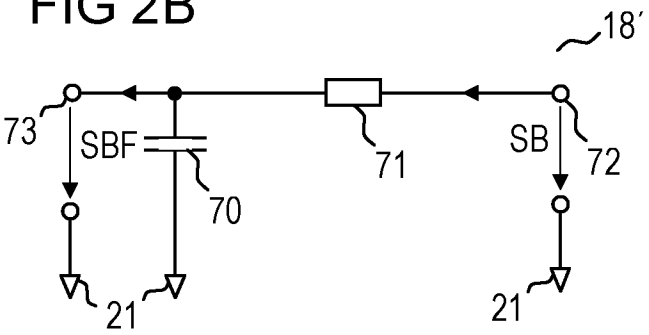
FIGS. 2A-2D show embodiment examples of filter circuits according to the proposed principle.
Figure 2A:
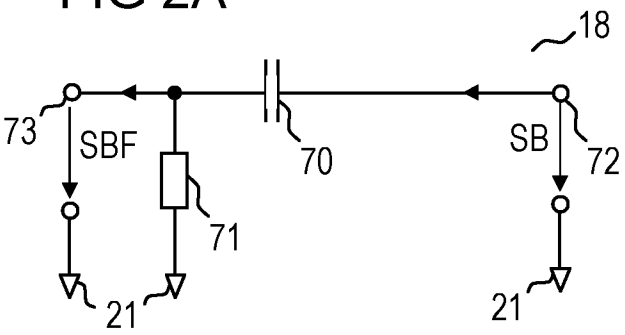

FIG. 2A shows an embodiment example of the filter circuit 18. The filter circuit 18 is realized in the form of a high-pass filter. The filter circuit 18 comprises a capacitor 70 and a filter resistor 71. A filter input 72 of the filter circuit 18 is coupled to a filter output 71 of the filter circuit 18 via the capacitor 70. The filter output 73 is connected to the reference potential terminal 21 via the filter resistor 71. A filter circuit 18 of the type suitable for use, e.g., in the voltage supply arrangements 10 according to FIGS. 1A, 1B and 1D, is therefore inexpensively realized.

FIG. 2B shows another embodiment example of the filter circuit 18'. According to FIG. 2B, the filter circuit 18' is implemented in the form of a low-pass filter. The filter input 72 is connected to the filter output 73 via the filter resistor 71. The filter output 73 is coupled to the reference potential terminal 21 via the capacitor 70. The filter circuit 18' is therefore realized in the form of a low-pass filter of the type suitable for use, for example, in the voltage supply arrangement 10 according to FIG. 1C in a space-saving fashion.

Figure 2D:
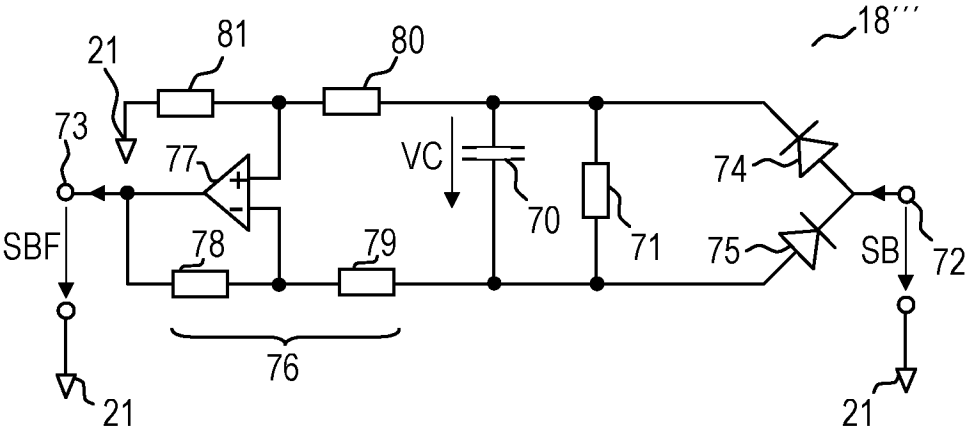
Figure 2C:
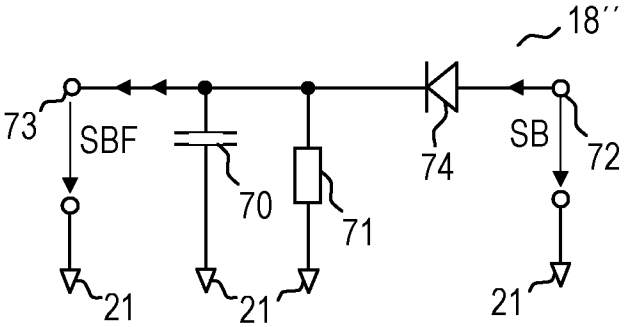

FIG. 2C shows another embodiment example of the filter circuit 18". The filter circuit 18" is realized in the form of a peak value detector. The filter circuit 18" has a high-pass characteristic. The filter circuit 18" comprises a diode 74, the capacitor 70 and the filter resistor 71. The filter input 72 is connected to the filter output 73 via the diode 74. The filter output 73 is coupled to the reference potential terminal 21 via a parallel circuit comprising the capacitor 70 and the filter resistor 71. The capacitor 70 is therefore charged when the driver signal SB increases above the voltage value of the capacitor 70. Consequently, a peak value of the driver signal SB is switched through from the filter input 72 to the filter output 73. The filter resistor 71 leads to a drop of the voltage at the filter output 73. The drop of the voltage at the filter output 73 is adjusted by means of a time constant that is equal to the product of the capacitance value of the capacitor 70 and the resistance value of the filter resistor 71. It is advantageous that positive deflections of the driver signal SB effectively result in a filtered driver signal SBF such that a measurement signal SI leading to a reduction of the feedback signal VFB is generated. The filter circuit 18" according to FIG. 2C can be utilized, for example, in the voltage supply arrangements according to FIGS. 1A, 1B and 1D.

FIG. 2D shows another embodiment example of the filter circuit 18'". The filter circuit 18'" comprises the diode 74, the capacitor 70, the filter resistor 71 and an additional diode 75. The filter input 72 is connected to a first electrode of the capacitor 70 via the diode 74. In addition, the filter input 72 is connected to a second electrode of the capacitor 70 via the additional diode 75. In this case, the anode of the diode 74 is connected to the filter input 72 and the cathode of the diode 74 is connected to the first electrode of the capacitor 70. In contrast, the anode of the additional diode 75 is connected to the second electrode of the capacitor 70 and the cathode of the additional diode 75 is connected to the filter input 72. The filter resistor 71 connects the first electrode to the second electrode of the capacitor 70. A differential amplifier 76 couples the first and the second electrode of the capacitor 70 to the filter output 73. The differential amplifier 76 features an operational amplifier 77, as well as a first, a second, a third and a fourth differential amplifier resistor 78-81.

The filter arrangement 18'" according to FIG. 2D is realized in the form of a peak value detector. Positive peaks of the driver signal SB lead to charging of the first electrode of the capacitor 70 via the diode 74 that is conductive at positive peaks of the driver signal SB. Minima of the driver signal SB lead to discharging of the second electrode of the capacitor 70 via the additional diode 75 that is conductive at minima of the driver signal SB. The capacitor voltage VC dropping between the first electrode and the second electrode of the capacitor 70 therefore represents the range between a maximum and a minimum of the driver signal SB. The filter resistor 71 serves for the reduction of the voltage VC dropping across the capacitor 70. The reduction of the capacitor voltage VC takes place with the time constant that was already described with reference to FIG. 2C. The differential amplifier 76 converts the capacitor voltage VC into the filtered driver signal SBF. The differential amplifier 76 generates the filtered driver signal SBF from the capacitor voltage VC in such a way that the filtered driver signal is based on the reference potential of the reference potential terminal 21. The filtered driver signal SBF is therefore proportional to the difference between a maximum and a minimum of the driver signal SB.

The filtered driver signal SBF according to FIGS. 2B-2D advantageously has, in particular, a substantial DC signal component and only a small AC signal component such that the further processing by means of the first comparator 19 can be easily realized.

Figure 3A:
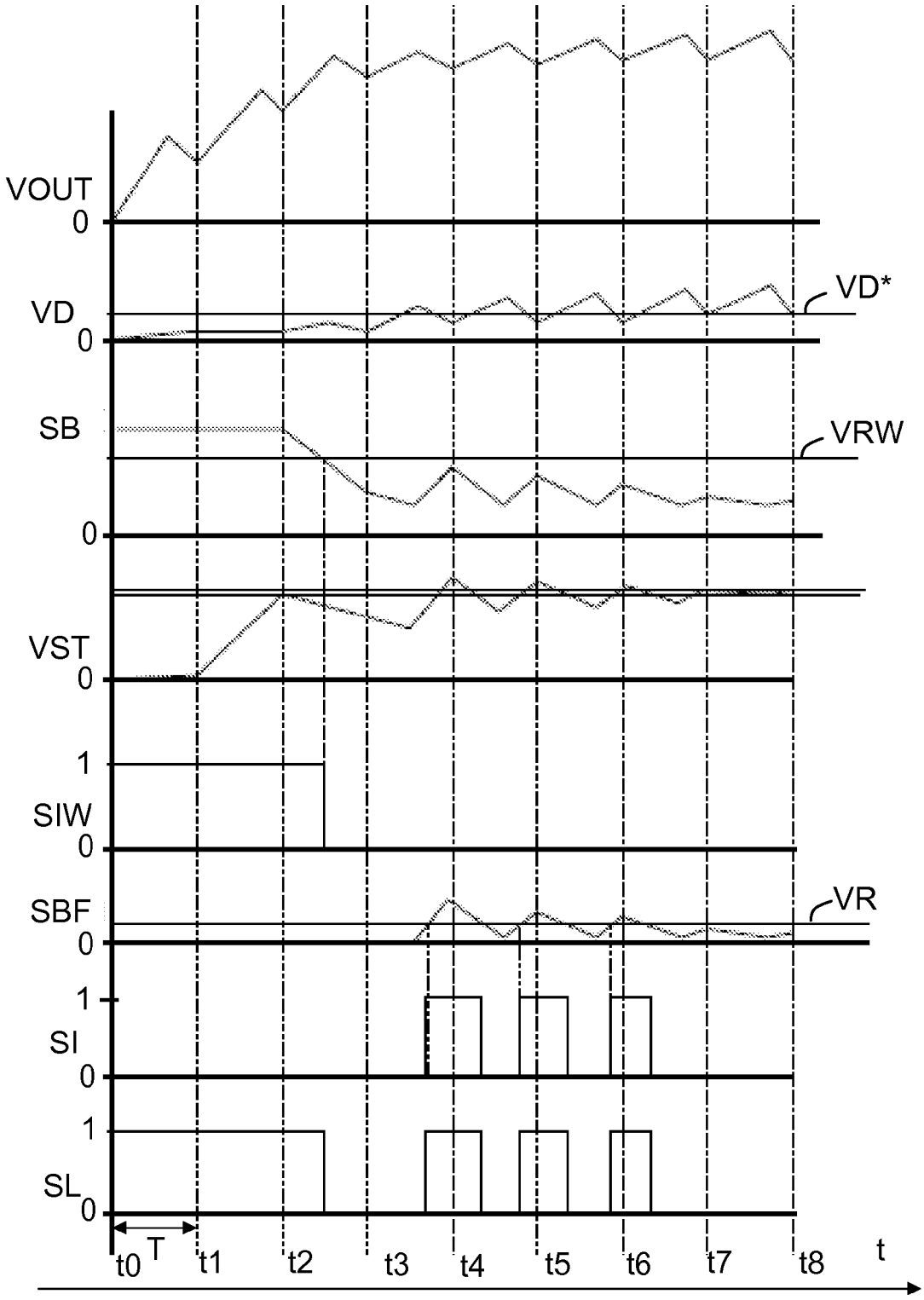
FIGS. 3A-3C show embodiment examples of signal curves in a voltage supply arrangement according to the proposed principle.

FIG. 3A shows an embodiment example of a signal curve of a voltage supply arrangement according to the proposed principle. FIG. 3A shows the signal curve that can be attained in the voltage supply arrangement 10 according to FIG. 1A. The supply voltage VOUT, the current source voltage VD, the driver signal SB, the current measurement signal VST, the additional measurement signal SIW, the filtered driver signal SBF, the measurement signal SI and the logic signal SL are illustrated according to a time t. In this case, the detection of the DC component and of the AC component of the driver signal SB is illustrated during a starting phase of the voltage supply arrangement 10. The supply voltage VOUT is initially increased by means of the feedback mechanism until the additional measurement signal SIW changes from the logic value "1" to the logic value "0." Subsequently, the supply voltage VOUT is additionally increased by means of the device 13 for determining an AC signal component of the driver signal until the transistor 42 is in saturation and the AC component of the driver signal SB lies below the predefined value VR.

The circumstances are described after switching on the voltage regulator 28 at a starting time t0. One period T of the voltage regulator 28 elapses between the first time t1 and the starting time t0. During a first period between the starting time t0 and the first time t1, the supply voltage VOUT is very low and increases from the value 0 V. The driver signal SB has a very high value. Since the supply voltage VOUT is low, the current source voltage VD and the feedback signal VST also have a very low value. Due to the diode characteristic of the light-emitting diodes 38-41, a load current IL does not yet flow at these low values of the supply voltage.

The increase of the supply voltage VOUT during a second period between the first time t1 and a second time t2 leads to an increase of the feedback signal VST. The driver signal SB still has a very high value in order to adjust the current source 35 into a highly conductive state. During a third period between the second time t2 and a third time t3, the supply voltage VOUT additionally increases such that the driver signal SB can decrease from its maximum value. The driver signal SB therefore falls short of the value of the comparison signal VRW. Consequently, the additional measurement signal SIW only has the logic value "1" during the first and the second period, as well as during part of the third period.

The supply voltage VOUT additionally increases during a fourth period between the third time t3 and a fourth time t4, as well as during a fifth period between the fourth time t4 and a fifth time t5. This leads to an increase of the current source voltage VD and to an additional decrease of the driver signal SB. However, the driver signal SB is subject to significant fluctuations such that the filtered driver signal SBF intermittently assumes values above the reference signal VR. This leads to the measurement signal SI assuming the logic value "1" in sections during the fourth and the fifth period. Since the logic signal SL also assumes the logic value "1" during the fourth and the fifth period, the voltage regulator 28 is driven in such a way that the supply voltage VOUT also additionally increases in the fifth and the sixth period. This is also the case during a sixth period between the fifth time t5 and a sixth time t6 and during a seventh period between the sixth time t6 and a seventh time t7.

During an eighth period between the seventh time t7 and an eighth time t8, the filtered driver signal SBF is smaller than the reference signal VR such that the measurement signal SI and the logic signal SL constantly assume the logic value "0." In this case, the current source voltage VD has such a high value that it suffices for the operation of the current source 35. The feedback signal VST now only has very slight fluctuations such that the load current IL and therefore the light quantity emitted by the light-emitting diodes 38-41 are approximately constant. The driver signal SB likewise has only slight fluctuations. Since the transistor 42 of the current source 35 is now operated above the saturation voltage, the fluctuations of the supply voltage VOUT only cause fluctuations of the current source voltage VD and neither lead to significant changes of the load current IL nor to significant changes of the driver signal SB. The value VD* corresponds to the minimum voltage for operating the transistor 42 above the saturation voltage, i.e., for operating a field effect transistor in the saturation range.

A control of the voltage regulator 28 can be advantageously realized without feeding the current source voltage VD to the driver circuit 11. The feedback signal VFB is adjusted without feeding the current source voltage VD to the driver circuit 11. A connection to the driver circuit 11 in the load path 34 between the current source 35 and the electrical load 37 is therefore avoided. In this way, fewer connecting lines and pads are required. The driver circuit 11 is designed for driving the voltage regulator 28 in such a way that the absolute value of the supply voltage VOUT is at such a high ripple of the supply voltage VOUT that a suitably high current source voltage VD is achieved. This leads to a reduced ripple of the load current IL.

Figure 3B:
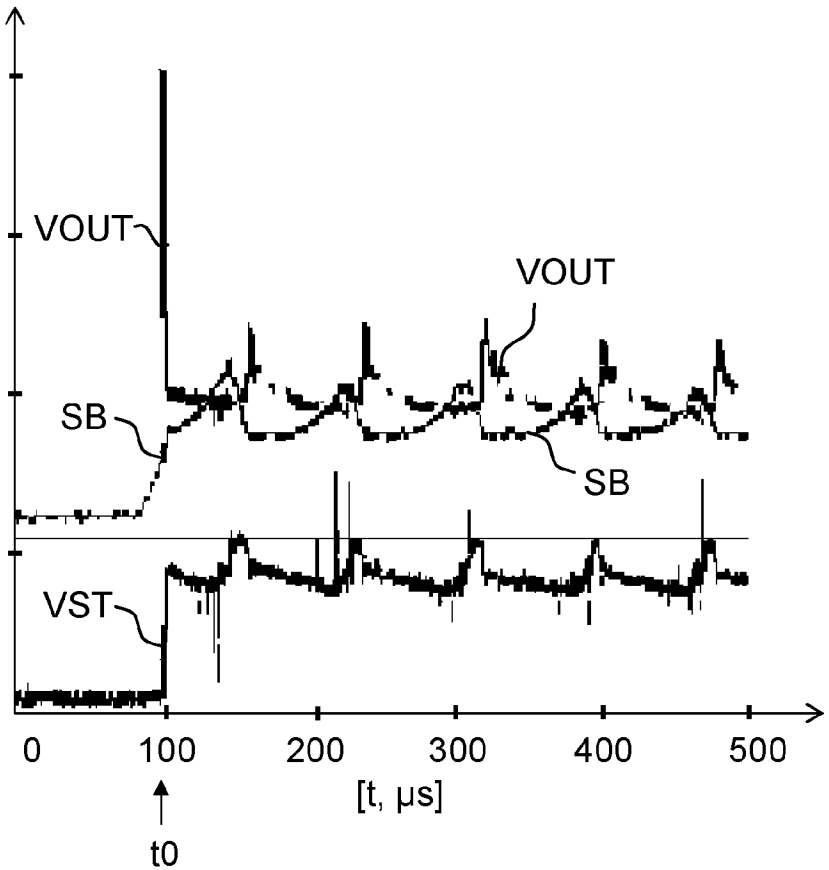
Figure 3C:
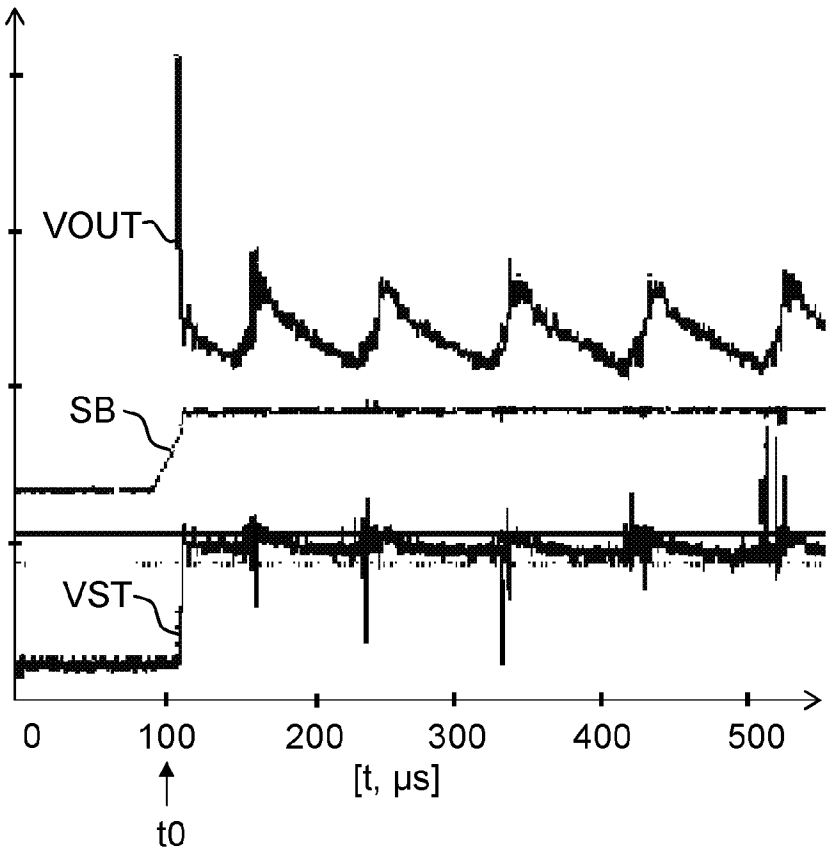

FIG. 3B shows an embodiment example of signal curves of a conventional voltage supply arrangement. FIG. 3C, in contrast, shows an embodiment example of signal curves of a voltage supply arrangement according to the proposed principle. According to FIGS. 3B and 3C, the voltage regulator is already in operation prior to the starting time t0. At the starting time t0, the driver signal SB is increased. This leads to a rapid increase of the load current IL and therefore the feedback signal VST shortly after the starting time t0. The increase of the load current IL results in a drop of the supply voltage VOUT. A supply voltage VOUT with voltage peaks that, according to FIG. 3B, lead to a ripple of the feedback signal VST of approximately 135 mV results in accordance with the clocked operation of the voltage regulator 28. The driver circuit 11 attempts to compensate the ripple of the feedback signal VST with corresponding changes of the driver signal SB.

According to FIG. 3C, the voltage regulator 28 is adjusted in such a way that the supply voltage VOUT and therefore the current source voltage VD are sufficiently high. Although the supply voltage VOUT has a high ripple, the ripple is absorbed by the current source 35 due to the operation of the transistor 42 above the saturation voltage such that the feedback signal VST only has slight fluctuations on the order of 72 mV. The driver signal SB and the load current IL are therefore nearly constant. The transistor 42 can be advantageously adjusted by means of the driver circuit 11 in such a way that it is operated above the saturation voltage. A conventional voltage supply arrangement, in contrast, only makes it possible to detect whether the transistor 42 is within the linear or triode range or outside the control range.

LIST OF REFERENCE SYMBOLS

10 Voltage supply arrangement
11 Driver circuit
12 Driver output
13 Device for determining an AC signal component of the driver signal
14 Device for determining a DC signal component of the driver signal
15 Evaluation circuit
16 Feedback output
17 Signal generator
18 Filter circuit
19 First comparator
20 Reference signal source
21 Reference potential terminal
22 Second comparator
23 Comparison signal source
24 Operational amplifier
25 Feedback input
26 Constant voltage source
27 Switch
28 Voltage regulator
29 Voltage regulator output
30 Feedback input
31 Voltage divider
32 First voltage-dividing resistor
33 Second voltage-dividing resistor
34 Load path
35 Current source
36 Means for connecting an electrical load
37 Electrical load
38-41 Light-emitting diode
42 Transistor
43 Current-sensing resistor
44 Feedback terminal
45 Logic gate
46 Control circuit
47 Voltage regulator input
60 Additional switch
61 Controlled current source
62 State machine
63 Coupling resistor
64 Coupling capacitor
65 Series resistor
66 Node
67 Additional control transistor
68 Control resistor
69 Control capacitor
70 Capacitor
71 Filter resistor
71 Filter input
73 Filter output
74 Diode
75 Additional diode
76 Differential amplifier
77 Operational amplifier
78-81 Differential amplifier resistor
IL Load current
SB Driver signal
SBF Filtered driver signal
SI Measurement signal
SIW Additional measurement signal
SL Logic signal
SP Activation signal
t0 Starting time
t1 First time
t2 Second time
t3 Third time
t4 Fourth time
t5 Fifth time
t6 Sixth time
t7 Seventh time
t8 Eighth time
VC Capacitor voltage
VD Current source voltage
VFB, VFB' Feedback signal
VIN Input voltage
VK Constant voltage
VOUT Supply voltage
VR Reference signal
VRW Comparison signal
VST Feedback signal

The invention claimed is:

1. A voltage supply arrangement for driving an electrical load, particularly a light-emitting diode, comprising a driver circuit with a driver output for making available a driver signal for controlling a load path that comprises a means for connecting the electrical load, with the driver signal controlling a load current flowing through the load path and having an AC signal component, and a device for determining the AC signal component of the driver signal, the input side of which is coupled to the driver output and at the output side of which can be tapped a measurement signal that is dependent on the AC signal component of the driver signal, with a supply voltage of the load path being adjustable according to said measurement signal, wherein the voltage supply arrangement comprises a voltage regulator that is implemented in the form of a DC/DC converter and delivers the supply voltage to the load path with a ripple.

2. The voltage supply arrangement according to claim 1, wherein the AC signal component of the driver signal corresponds to the ripple of the driver signal during a period of the operating phases of the voltage regulator that can be connected, at the output of which the supply voltage can be tapped.

3. The voltage supply arrangement according to claim 1 or 2, wherein the driver circuit is designed for generating the measurement signal in such a way that the AC signal component of the driver signal is smaller than a predefined value.

4. The voltage supply arrangement according to claim 1, wherein the load path comprises a current source, the control side of which is connected to the driver output, the means for connecting the electrical load that is arranged in series with the current source, and a feedback terminal that is coupled to a feedback input of the driver circuit.

5. The voltage supply arrangement according to claim 4, wherein the current source comprises a transistor that is realized in the form of a bipolar transistor or a field effect transistor and the control terminal of which is coupled to the driver output, and wherein the driver circuit is designed for generating the measurement signal in such a way that the bipolar transistor is operated in the normal mode or the field effect transistor is operated in the saturation range.

6. The voltage supply arrangement according to claim 1, wherein the device for determining the AC signal component of the driver signal comprises a filter circuit and a first comparator with a first input that is coupled to the driver output via the filter circuit and an output at which the measurement signal can be tapped.

7. The voltage supply arrangement according to claim 6, wherein the filter circuit features a circuit from a group comprising a high-pass filter, a low-pass filter and a peak value detector.

8. The voltage supply arrangement according to claim 6 or 7, wherein a second input of the first comparator is coupled to an output of a reference signal source at which a predefined reference signal can be tapped, or to the driver output.

9. The voltage supply arrangement according to claim 1, with the driver circuit comprising a device for determining a DC signal component of the driver signal, the input side of which is coupled to the driver output and at the output side of which can be tapped an additional measurement signal that is dependent on the DC signal component of the driver signal, wherein the supply voltage can be adjusted according to the measurement signal and the additional measurement signal.

10. The voltage supply arrangement according to claim 9, wherein the device for determining a DC signal component of the driver signal comprises a second comparator with a first input that is coupled to the driver output, a second input that is coupled to an output of a comparison signal source, at which a predefined comparison signal can be tapped, and an output, at which the additional measurement signal can be tapped.

11. The voltage supply arrangement according to claim 9 or 10, wherein the driver circuit comprises an evaluation circuit with a first input, to which the measurement signal can be fed, a second input, to which the additional measurement signaler can be fed, and an output, at which a feedback signal can be tapped, wherein said feedback signal can be determined from the measurement signal and the additional measurement signal and is designed for adjusting the voltage conversion from an input voltage into the supply voltage.

12. The voltage supply arrangement according to claim 11, wherein the evaluation circuit comprises a logic gate, a first input of which is connected to the first input of the evaluation circuit, a second input of which is connected to the second input of the evaluation circuit and an output of which is coupled to the output of the evaluation circuit.

13. The voltage supply arrangement according to claim 11, wherein the voltage regulator comprises a voltage regulator input for supplying an input voltage, a voltage regulator output, to which the load path can be coupled and at which the supply voltage can be tapped, and a feedback input that is coupled to the output of the evaluation circuit.

14. The voltage supply arrangement according to claim 1, wherein the voltage regulator is operated in a clocked fashion.

15. A method for supplying voltage to an electrical load, particularly a light-emitting diode, comprising the steps of:

converting an input voltage into a supply voltage of a load path according to a feedback signal, wherein a voltage regulator is implemented in the form of a DC/DC converter and delivers the supply voltage to the load path with a ripple, controlling a load current flowing through the load path by means of a driver signal that has an AC signal component, determining the AC signal component of the driver signal, and generating the feedback signal according to the AC signal component of the driver signal.

* * * * *